United States Patent [19]

Watson

[11] 4,275,532

[45] Jun. 30, 1981

[54] SHIELD DEVICE AND ROOF STRUCTURE CONTAINING SAME

[76] Inventor: Roy W. Watson, 3218 Woodrow Ave., Richmond, Va. 23222

[21] Appl. No.: 47,440

[22] Filed: Jun. 11, 1979

[51] Int. Cl.[3] ..... A01K 3/00; E04B 1/72; E04H 9/16

[52] U.S. Cl. ..... 52/15; 52/94; 52/101

[58] Field of Search ..... 52/15, 94, 101, 714, 52/547; 49/71; 160/46

[56] References Cited

U.S. PATENT DOCUMENTS

| | | | |
|---|---|---|---|
| 1,585,503 | 5/1926 | Larsen | 52/94 |
| 1,585,897 | 5/1926 | Davidson | 52/547 X |
| 1,752,593 | 4/1930 | Giordano | 52/553 |
| 1,855,357 | 4/1932 | Kuehn | 52/94 |
| 2,976,648 | 3/1961 | Linck | 52/467 |
| 3,107,401 | 10/1963 | Heirich | 52/15 |
| 3,143,165 | 8/1964 | Lewis et al. | 52/15 X |
| 3,634,984 | 1/1972 | Murphy | 52/101 |

*Primary Examiner*—Alfred C. Perham
*Attorney, Agent, or Firm*—Norman B. Rainer

[57] ABSTRACT

A shield device is provided for preventing entrance of birds into a gutter underlying a roof comprised of corrugated panels. The shield device is comprised of a substantially flat shield member and a bracket centrally disposed on the rear face of said shield member. The bracket is comprised of a shelf portion and gripping means positioned beneath said shelf portion adjacent the outermost extremity thereof. The gripping means are adapted to enclasp and thereby frictionally engage a lip associated with the front edge of said gutter. A multitude of said shield devices is utilized to occlude the archways formed between adjacent corrugations resting in abutment with the front edge of said gutter.

2 Claims, 6 Drawing Figures

SHIELD DEVICE AND ROOF STRUCTURE CONTAINING SAME

BACKGROUND OF THE INVENTION

This invention relates to apparatus for preventing entrance of birds into a gutter which functions as a conduit for rainwater, and more particularly concerns apparatus of said nature associated with a corrugated roof structure overlying a gutter.

The use of corrugated panels in the fabrication of roof structures is well known in the housing industry. Such structures are generally designed to extend in a downwardly sloped mode from an existing building, thereby forming the roof of a protected area or room such as a patio, porch, carport or the like appended to said building. Corrugated panels may also be employed in fabricating the sole roof of independent buildings.

The nature of the corrugated configuration of the panels is such that the panels are comprised of an integral series of contiguous uniform trough-like depressions interconnected by ridges which, when viewed from the reverse side, are also trough-like depressions. In sectional view taken transverse to the long axis of the trough-like depressions, the corrugated panel has a wave-like pattern of sinusoidal uniformity, the pattern having either a curvilinear contour or angular configuration, or combinations thereof. The panels are generally formed by roll-forming or embossing operations carried out on flat sheet stock material such as thin gauge aluminum, galvanized iron, or plastics, and generally have a rectangular outer perimeter.

The corrugations cause the panel to have rigidity with respect to forces imposed in a plane transverse to the direction of the corrugations, namely the direction of the long axis of said trough-like depressions. When utilized as a roofing material, the panels are arranged such that the direction of the corrugations follows the downwardly sloped disposition of the panel. The upper or proximal edge of said panel is generally anchored to the host building and the lower or distal edge is generally supported by an adjacently placed cross beam, pillar, wall or equivalent structural support.

Because the proximal edge of the corrugated panel has a sinusoidal contour, when it is placed in downwardly angled abutment with a flat surface of a host building, a small gap will exist between the building and the upraised portions of the panel. Said gap would permit entrance of rainwater, expecially if the rainwater is wind-driven into the side of the building supporting said panels. In order to avoid the undesired entrance of rainwater into the gap between the panel and the building, a gutter structure is generally positioned below said proximal edge. The forward edge of said gutter may also serve as a support ledge for the panel.

Although the aforesaid manner of joining the proximal edge of a corrugated panel to a host building solves certain problems, it has been found to engender the new problem of providing a particularly inviting nesting location for birds. Small birds will enter the gutter from the underside of the panel within the archways between the bights of adjacent trough-like depressions of the panel. Not only will the nest obstruct the gutter, but the continued presence of birds closely adjacent the building is generally considered to be a nuisance.

Although means might be conceived for occluding the archways on the underside of the corrugated panel adjacent the gutter, accessability of said gutter is needed in order to facilitate periodic removal of accumulations of solid debris of wind-borne and water-borne origin. Complete enclosure of said gutter, though effective in excluding birds and debris, would thwart evaporation of water, thereby producing corrosion-producing conditions within said gutter.

It is accordingly an object of the present invention to provide means for preventing the entrance of birds into a gutter underlying a corrugated panel roof.

It is a further object to provide a device of simple and durable construction for preventing the entrance of birds into a gutter underlying a corrugated panel roof.

It is another object of this invention to provide a device of the aforesaid nature amenable to facile installation on and removal from said gutter.

It is a still further object to this invention to provide a corrugated roof structure supported at its upper edge by a gutter and provided with means for preventing entrance of birds into said gutter.

These and other objects and advantages of the invention will be apparent from the following description.

SUMMARY OF THE INVENTION

The above and other beneficial objects and advantages are accomplished in accordance with the present invention by the provision of a shield device adapted for removable attachment to a gutter underlying a corrugated roof panel in a manner to partially occlude access passageways into said gutter, thereby preventing entrance of birds thereinto.

In a preferred embodiment, the device is comprised of a flat shield member contoured so as to have a vertical axis of symmetry and a lower edge which, when measured horizontally in the plane of the shield member, is longer than horizontal dimensions adjacent the upper portion of said shield member. Associated with the rear face of said shield member is a bracket comprised of a flat horizontally disposed shelf portion originating at said rear face and extending rearwardly therefrom, and gripping means positioned beneath said shelf portion adjacent the outermost extremity thereof and adapted to frictionally engage a lip associated with the front edge of said gutter.

In a particularly preferred embodiment of the device of this invention, said bracket is attached to the rear face of the shield member by a base portion integral with said shelf portion as a continuous extension thereof, and the gripping means is a flat horizontally disposed reentrant surface lying closely adjacent the underside of said shelf portion, having been formed by downward and forward bending of the outermost extremity of said shelf portion along a line parallel to said shield member.

A multitude of the shield devices of this invention will be utilized to achieve its intended function in association with a roof structure comprised of corrugated panels supported at their uppermost end by a gutter attached to a building.

BRIEF DESCRIPTION OF THE DRAWINGS

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
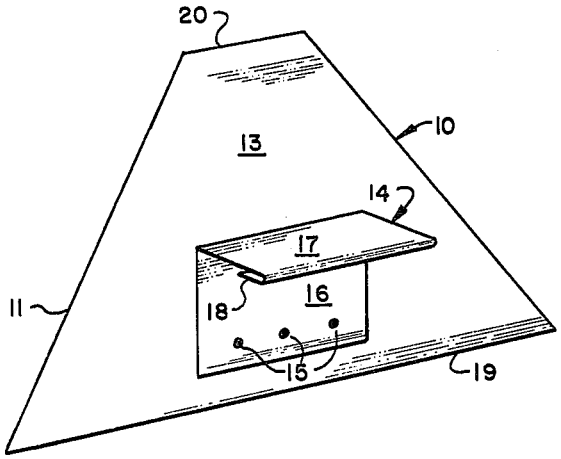
FIG. 1 is a rear perspective view of an embodiment of shield device of the present invention.
Figure 2:
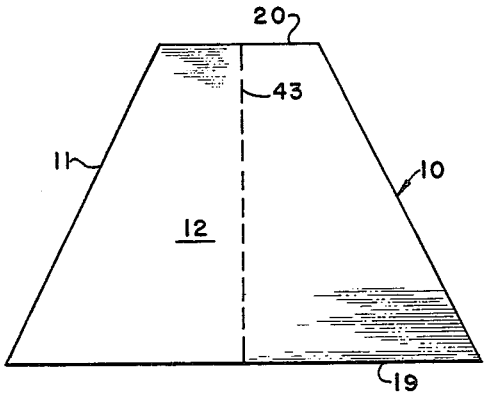
FIG. 2 is a front elevational view of the device of FIG. 1.

Referring now specifically to the drawings, it will be seen that the numeral 10 generally designates the shield device of this invention. As shown in FIGS. 1 and 2, the shield device is comprised of a substantially flat shield member 11 having a front face 12 and rear face 13. The lower edge 19 of shield member 11 is longer than its upper edge 20. The shield member is symmetric about vertical axis 43. A bracket 14 is attached by spot welded sites 15 or equivalent attachment means to rear face 13, said bracket being comprised of a base portion 16, a shelf portion 17 and gripping means in the form of reentrant surface 18 spaced closely adjacent the underside of shelf portion 17. In the embodiment of FIG. 1, said bracket is an integral structure formed by the bending of an initially flat piece of material, and is attached by base portion 16 to rear face 13 of shield member 11. The shield device is preferably constructed of thin gauge metal such as aluminum or galvanized iron, or may be fabricated from plastic materials such as polyvinylchloride, styrene copolymers and equivalent compositions. Although the shield member has been exemplified as a flat structure, non-flat structures such as embossed or crenulated shield members may be employed for certain decorative effects.

Figure 6:
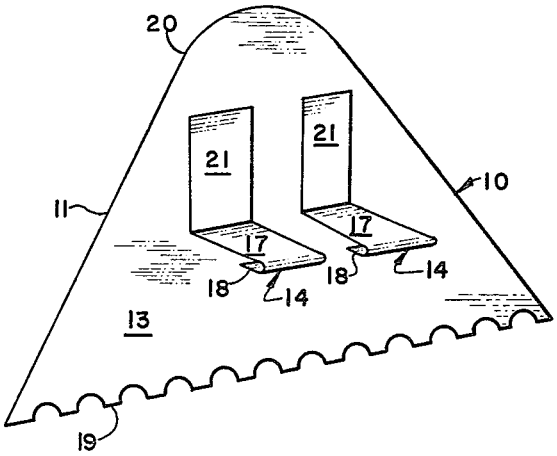
FIG. 6 is a rear perspective view of another embodiment of shield device.

In the alternative embodiment of shield device illustrated in FIG. 6, brackets 14 are fabricated as integral parts of shield member 11 by cutting said shield member and bending the pendant strips of material downwardly to form shelf portions 17 and inwardly to form reentrant surfaces 18. The openings 21 from which material for forming the brackets was taken are sufficiently small to prevent passage of birds. The lower edge 19 of shield member 11 is made to have a non-straight decorative configuration.

Although the upper surface of shelf portion 17 is shown to have a generally rectangular configuration, other equivalent configurations are contemplated within the purview of this invention. The shelf portion 17 is preferably disposed perpendicularly with respect to shield member 11. The distance of extension of shelf portion 17 away from the rear face 13 of shield member 11 must be greater than the width of the lip of the gutter with which the shield device is associated, as will be described in greater detail hereinafter. The spacing of reentrant surface 18 with respect to the underside of shelf portion 17 is critical because said spacing is required to achieve frictional gripping engagement with the lip of said gutter, as will hereinafter be shown.

Figure 3:
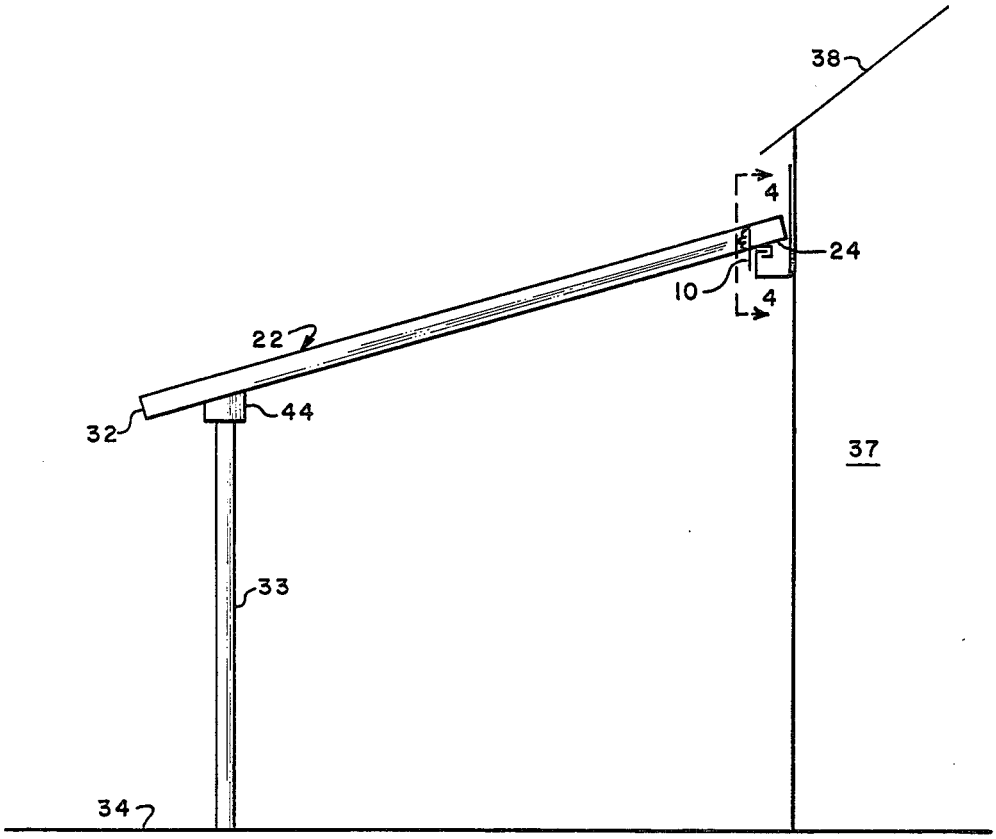
FIG. 3 is a side view of a corrugated panel roof structure utilizing a multitude of devices of FIG. 1 with parts being broken away to reveal interior detail.
Figure 4:
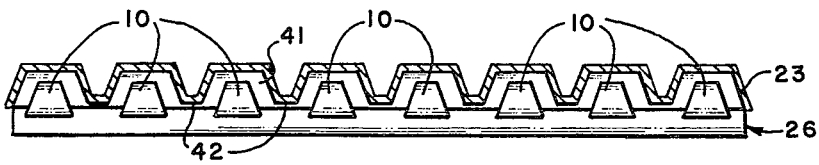
FIG. 4 is a sectional view taken along the lines 4—4 of FIG. 3.
Figure 5:
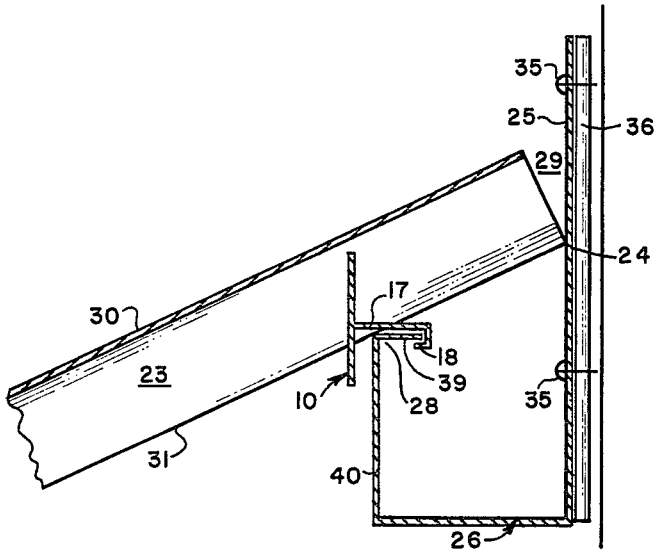
FIG. 5 is an enlarged fragmentary view of the gutter and shield device of FIG. 3.

FIG. 3 shows a downwardly sloped roof 22 fabricated of corrugated panels 23. The proximal or upper edge 24 of said panels abuts with the rear mounting extension 25 of gutter 26, forming a gap 29 between the upper surface 30 of said panels and said rear mounting extension. Said panels are further supported adjacent their proximal edge by resting abutment of their lower surface 31 with the front edge 28 of said gutter. Said panels are supported adjacent their distal end 32 by transverse beam 44, supported by column 33 or equivalent structure extending upwardly from the ground or floor 34. The gutter is attached by bolts 35 or equivalent means to the fascia 36 attached to the side of a building 37 beneath the terminal edge of its roof 38. The gutter may be further characterized as having an inwardly disposed lip 39 horizontally extending from front edge 28 toward rear mounting extension 25 as a continuous integral extension of the vertical front wall 40 of said gutter.

In installing the shield devices, each such device is initially brought to a position of close proximity to the archway 41 formed between adjacent bights 42 of said corrugated panel and front edge 28 of gutter 26. The shield device is then manipulated so that its reentrant surface 18 extends beyond the edge of lip 39, whereupon the shield device is pulled forward, away from said building, causing enclasping engagement of lip 39 by reentrant surface 18 and associated closely spaced shelf portion 17. The procedure for placement of the shield devices is repeated until all the archways 41 are occluded with a shield device.

When positioned on the gutter, the shield member 11 of the shield device will be substantially parallel to the vertical front wall 40 of gutter 26 and spaced therefrom by a distance of between about ½" and 1½". The distance of separation of the upper periphery of said shield member from the lower surface 31 of said corrugated panels within archway 41 is similarly between about ½" and 1½". Said spacing dimensions are such as to prevent entrance of birds into gutter 26, yet permit adequate air circulation so as to permit evaporation of water within gutter 26. The shield devices remain in place by virtue of the frictional holding effect of said gripping means, and can be removed when desired merely by disengaging said gripping means.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A shield device adapted for removeable attachment to the front edge of a gutter underlying a corrugated roof panel comprising:

(a) a substantially flat shield member contoured so as to have a vertical axis of symmetry and a lower edge which, when measured horizontally in the plane of said shield member, is longer than horizontal dimensions adjacent the upper portion of said shield member, (b) a bracket associated with the rear face of said shield member at substantially the center thereof comprised of a shelf portion originating at said rear face and extending rearwardly therefrom, and (c) gripping means positioned beneath said shelf portion adjacent the rearward extremity thereof and adapted to frictionally engage a horizontally disposed lip associated with the front edge of said gutter, (d) said gripping means being a flat horizontally disposed reentrant surface lying closely adjacent the underside of said shelf portion and having been formed by downward and forward bending of the rearward extremity of said shelf portion along a line parallel to said shield member.

2. An inclined roof structure comprised of corrugated panels, a gutter having an outer edge and inwardly disposed lip associated therewith, said panels being supported by resting abutment with said outer edge, and a multitude of shield devices positioned by enclasping frictional engagement with said lip in a manner to occlude passageways leading from the underside of said panels into said gutter, each of said shield devices being comprised of:

(a) a substantially flat shield member contoured so as to have a vertical axis of symmetry and a lower edge which, when measured horizontally in the plane of said shield member, is longer than horizontal dimensions adjacent the upper portion of said shield member, (b) a bracket associated with the rear face of said shield member at substantially the center thereof comprised of a shelf portion originating at said rear face and extending rearwardly therefrom, and (c) gripping means positioned beneath said shelf portion adjacent the rearward extremity thereof and adapted to frictionally engage a horizontally disposed lip associated with the front edge of said gutter.

* * * * *